US007578460B2

(12) United States Patent
Berger

(10) Patent No.: US 7,578,460 B2
(45) Date of Patent: Aug. 25, 2009

(54) FOOD WASTE DISPOSER HAVING ANTIMICROBIAL COMPONENTS

(75) Inventor: Thomas R Berger, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 618 days.

(21) Appl. No.: 10/463,293

(22) Filed: Jun. 17, 2003

(65) Prior Publication Data

US 2004/0256506 A1 Dec. 23, 2004

(51) Int. Cl.
*B02C 23/36* (2006.01)

(52) U.S. Cl. ..... 241/46.014

(58) Field of Classification Search ..... 241/46.012–46.016; 4/DIG. 4
See application file for complete search history.

(56) References Cited

U.S. PATENT DOCUMENTS

| | | | | | |
|---|---|---|---|---|---|
| 3,025,007 | A | | 3/1962 | Weiczorek | 241/46.015 |
| 4,533,435 | A | | 8/1985 | Intili | 162/161 |
| 5,474,797 | A | | 12/1995 | Sioshansi et al. | 427/2.24 |
| 5,520,664 | A | | 5/1996 | Bricault, Jr. et al. | 604/265 |
| 5,849,311 | A | * | 12/1998 | Sawan et al. | 424/406 |
| 5,906,825 | A | * | 5/1999 | Seabrook et al. | 424/404 |
| 5,919,554 | A | | 7/1999 | Watterson et al. | 428/201 |
| 5,924,635 | A | | 7/1999 | Koshimizu et al. | 241/46.015 |
| 6,007,006 | A | | 12/1999 | Engel et al. | 241/46.014 |
| 6,093,407 | A | * | 7/2000 | Cummings et al. | 424/400 |
| 6,108,847 | A | | 8/2000 | Cueman et al. | 15/104.94 |
| 6,171,496 | B1 | | 1/2001 | Patil | 210/484 |
| 6,238,575 | B1 | | 5/2001 | Patil | 210/764 |
| 6,248,342 | B1 | | 6/2001 | Trogolo et al. | 424/404 |
| 6,267,590 | B1 | | 7/2001 | Barry et al. | 433/8 |
| 6,283,308 | B1 | | 9/2001 | Patil et al. | 210/484 |
| 6,294,183 | B1 | * | 9/2001 | Ito et al. | 424/404 |
| 6,296,863 | B1 | | 10/2001 | Trogolo et al. | 424/404 |
| 6,365,130 | B1 | | 4/2002 | Barry et al. | 424/48 |
| 6,394,377 | B1 | | 5/2002 | Kim et al. | |
| 6,436,422 | B1 | | 8/2002 | Trogolo et al. | 424/405 |

(Continued)

FOREIGN PATENT DOCUMENTS

EP WO 02/17724 * 3/2002

(Continued)

OTHER PUBLICATIONS

International Search Report and Written Opinion of the International Searching Authority, Int. App. PCT/US2004/018416, Nov. 10, 2004.

*Primary Examiner*—Mark Rosenbaum
(74) *Attorney, Agent, or Firm*—Harness, Dickey & Pierce, P.L.C.

(57) ABSTRACT

A food waste disposer having one or more antimicrobial components is disclosed. The components can be metal, plastic, or rubber, and preferably constitute at least those components that a user could come in contact with during operation or maintenance of the disposer and/or components that come in contact with food waste. The plastic and rubber components can either be embedded or coated with an antimicrobial agent. The metal components are preferably powder coated. Exemplary components within the disposer benefiting from such antimicrobial treatment include a metal shredder plate, a metal shredder ring, a rubber mounting gasket, a rubber vibration isolation mount, a rubber vibration isolation tailpipe coupling, and the plastic discharge outlet and associated rubber seals.

33 Claims, 3 Drawing Sheets

U.S. PATENT DOCUMENTS

| | | | | |
|---|---|---|---|---|
| 6,439,487 | B1 | 8/2002 | Anderson et al. | 241/46.016 |
| 6,448,305 | B1 | 9/2002 | Watterson et al. | 523/122 |
| 6,481,652 | B2 | 11/2002 | Strutz et al. | 241/46.013 |
| 6,531,519 | B2 | 3/2003 | Patil | 521/33 |
| 6,540,916 | B2 | 4/2003 | Patil | 210/502.1 |
| 2002/0185559 | A1 | 12/2002 | Grimes | 241/21 |
| 2003/0096062 | A1 * | 5/2003 | Hoberman | 427/388.1 |

FOREIGN PATENT DOCUMENTS

| | | |
|---|---|---|
| GB | 630494 | 10/1949 |
| GB | 976011 | 11/1964 |
| JP | 2002 066929 A | 3/2002 |

* cited by examiner

FOOD WASTE DISPOSER HAVING ANTIMICROBIAL COMPONENTS

FIELD OF THE INVENTION

The present invention relates generally to food waste disposers and, more particularly, to a food waste disposer having one or more antimicrobial components.

BACKGROUND OF THE INVENTION

Food waste disposers are known in the art and are typically made of various metal, plastic, and rubber components. Food waste is fed into the disposer from a sink along with water, is reduced within the disposer, and is then flushed to the plumbing system of a house or commercial establishment. The reduced food waste can foster the growth of various microorganisms, such as bacteria, fungus, and mold. These microorganisms can cause objectionable odors within the disposer. They can also cause slimy films on the disposer components, which is particularly objectionable for components that disposer users may need to touch, such as the mounting gasket and the grinding plate within the disposer, which the user will probably perceive as unclean or unhealthy. In addition, microorganisms can potentially hinder operation of the disposer by degrading plastic or rubber components, thereby reducing the longevity of the disposer and its various components.

While these problems have long persisted in the food waste disposer art, the art contains only a very limited disclosure of the application of antimicrobial technologies to the components of a food waste disposers. For example, in U.S. Pat. No. 5,924,635, a flexible cylinder is disclosed which connects the disposer throat to the drain opening of a sink. This cylinder is formed of an antimicrobial rubber produced by adding 0.1% or more of an antimicrobial agent, such as an organic or inorganic iodine agent. However, the '635 patent suggests a narrow usage for such antimicrobial treatment. First, that patent does not recognize or suggest the applicability of antimicrobial technologies to components other than the flexible cylinder. In addition, that patent erroneously suggests that such rubberized antimicrobial components should only be used in a non-load bearing, non-vibration isolation capacity. See, e.g., '635 patent, col. 5, 11. 37-45. Moreover, only one type of antimicrobial treatment, i.e., embedding of iodine agents in a rubber matrix, is disclosed. In short, the art has barely recognized the utility of antimicrobial components in food waste disposers, despite a long felt need for suitable and more comprehensive solutions.

To that end, a need exists in the art for food waste disposers with components that can reduce or eliminate the growth of such microorganisms, which would allow the disposer to stay cleaner during use, make the disposer easier to clean, and reduce the potential for odors. Such solutions, proffered in this disclosure, have applicability to many of the different components in the disposer without significant regard for the component's function.

SUMMARY OF THE DISCLOSURE

A food waste disposer having one or more antimicrobial components is disclosed. The components can be metal, plastic, or rubber, and preferably constitute at least those components that a user could come in contact with during operation or maintenance of the disposer and/or components that come in contact with food waste. The plastic and rubber components can either be embedded or coated with an antimicrobial agent. The metal components are preferably powder coated. Exemplary components within the disposer benefiting from such antimicrobial treatment include a metal shredder plate, a metal shredder ring, a rubber mounting gasket, a rubber vibration isolation mount, a rubber vibration isolation tailpipe coupling, and the plastic discharge outlet and associated rubber seals.

BRIEF DESCRIPTION OF THE DRAWINGS

The foregoing summary, which constitute preferred embodiments, will be best understood with reference to a detailed description of specific embodiments, which follows, when read in conjunction with the accompanying drawings, in which.

Figure 1:
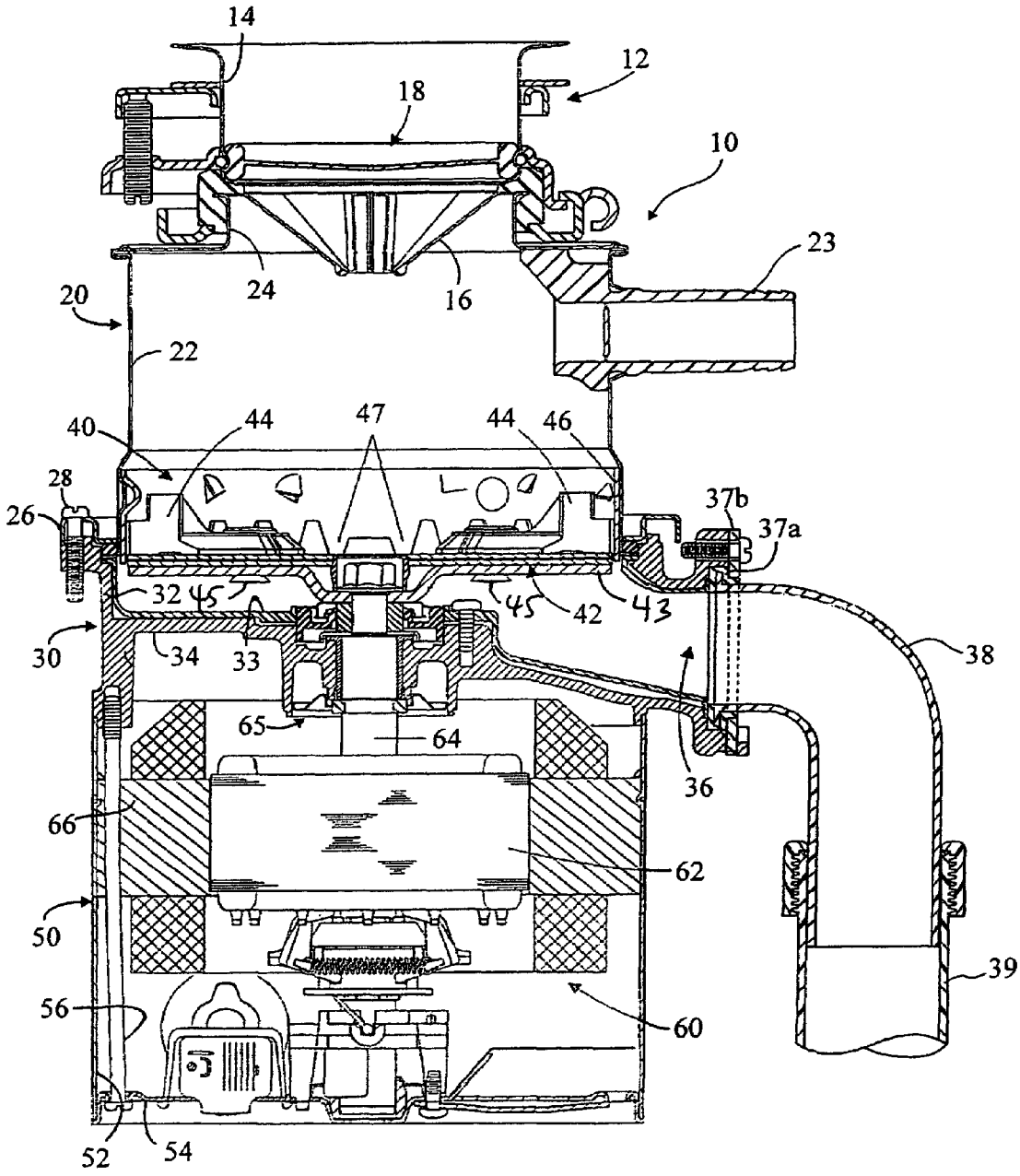
FIG. 1 illustrates a cross-section of one embodiment of a food waste disposer.

While the disclosed food waste disposers having one or more antimicrobial components are susceptible to various modifications and alternative forms, specific embodiments thereof have been shown by way of example in the drawings and are herein described in detail. The figures and written description are not intended to limit the scope of the inventive concepts. Rather, the figures and written description are provided to illustrate the inventive concepts to a person of skill in the art as required by 35 U.S.C. § 112.

DETAILED DESCRIPTION

In the interest of clarity, not all features of actual implementations of a food waste disposer having antimicrobial components are described in the disclosure that follows. It will of course be appreciated that in the development of any such actual implementation, as in any such project, numerous engineering and design decisions must be made to achieve the developers' specific goals, e.g., compliance with mechanical and business related constraints, which will vary from one implementation to another.

A. Description of Disposer Components

The main thrust of this disclosure is that several components of a food disposer can be made to inhibit microbial growth, which as noted earlier assists in keeping the disposer clean, in reducing odors, and in protecting the disposer from microbial degradation. Antimicrobial techniques are disclosed that can enhance both hydrocarbon components (e.g., plastic or rubber) and metal components. Before disclosing the applicability of these antimicrobial techniques to the components in a food waste disposer, it is useful to review the various components of food waste disposers that have been disclosed in the art. Thereafter, this disclosure will turn to the enhancement of these components through the use of the disclosed antimicrobial techniques.

Referring to FIG. 1, an embodiment of a food waste disposer 10 is illustrated in cross-section. Further details concerning the food waste disposer 10 and its various components are disclosed in U.S. Pat. Nos. 6,007,006, 6,481,652, and 6,439,487, which are incorporated herein by reference in their entireties. In the present embodiment, the disposer 10 includes an inlet housing 20, a grinding housing 30, and a motor housing 50. The motor housing 50 is composed of sheet metal forming a cylindrical wall 52. A lower end frame 54, typically made from stamped metal, is attached to the lower end of the motor housing 50. The motor housing 50 contains a motor 60 that includes a rotor 62, a shaft 64, and a stator 66. As is known, the motor 60 imparts rotational movement to the motor shaft 64 that passes through a sealing/bearing mechanism 65 to components in the grinding housing 30 discussed below.

The grinding housing 30 is attached to motor housing 50 by a plurality of bolts 56 connected to the lower end frame 54 and the grinding housing 30. The grinding housing 30 has a peripheral sidewall 32, a bottom surface 34, and a discharge outlet 36. The grinding housing 30 contains a grinding mechanism 40 for reducing food waste. A number of grinding mechanisms 40 known in the art can be used to reduce food waste in the disposer 10, such as those disclosed in U.S. Pat. Nos. 6,007,006 and 6,439,487, and U.S. patent application Ser. No. 10/790,311, filed Mar. 1, 2004, and entitled "Food Waste Reduction Mechanism for Disposer," which are incorporated herein by reference in their entireties. These and other grinding mechanisms can be used with the disposer 10 and can benefit from the disclosed antimicrobial techniques.

In the present embodiment, the grinding mechanism 40 includes a rotating shredder plate 42 with a lower support plate 43 adjacent thereto and a stationary shredder ring 46. The rotating shredder plate 42 and the lower support plate 43 are mounted to the motor shaft 64, which imparts rotation to the shredder plate 42 during operation of the disposer 10. Typically, the rotating shredder plate 42 has lugs 44 fastened to the plate 42 that may be fixed or free to rotate. In the illustrated embodiment, the lugs 44 are attached by a stationary attaching member 45 that extends through the rotating shredder plate 42 and the lower support plate 43, such that the lug 44 is rotatable about the member 45. The rotating shredder plate 42, the lower support plate 43 and the lugs 44 are preferably composed of stainless steel.

The stationary shredder ring 46 is attached to an inner surface of the inlet housing 20, but could also be attached to the inner wall 32 of the grinding housing 30 depending on the extent to which the grinding housing 30 encompasses the grinding mechanism 40 for a particular embodiment. The stationary shredder ring 46 is preferably composed of stamped, stainless steel. Alternatively, the stationary shredder ring 46 can be cast out of NiHard—an abrasion resistant nickel chromium martensitic white iron with a brinell hardness of 550 to 600. The stationary shredder ring 46 includes a plurality of teeth 47 for reducing food waste in conjunction with the lugs 44 on the rotating shredder plate 42.

In the present embodiment, the grinding housing 30 is composed of die cast metal. In an alternative embodiment, the grinding housing 30 can be formed of a suitable plastic, such as acrylonitrile butadiene styrene (ABS), polyvinyl chloride (PVC), polyester, polyphenylene sulfide, or possibly a bulk molding compound (BMC). Food waste reduced by the grinding mechanism 40 leaves the grinding housing 30 through the discharge outlet 36. Because the grinding housing 30 can be composed of die cast metal, a liner 33 composed of plastic may preferably used to direct the reduced food waste and water toward the discharge outlet 36 in the grinding housing 30.

Figure 3:
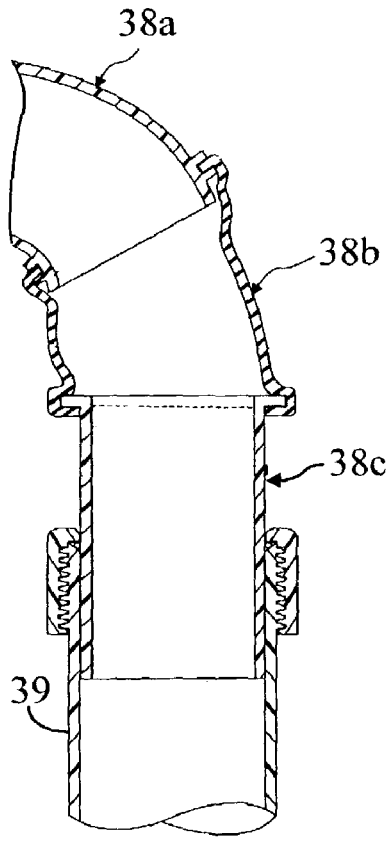
FIG. 3 illustrates a cross-section of an exemplary vibration isolation discharge coupling for connecting a tailpipe to a disposer.

Upon leaving the discharge outlet 36, the reduced food waste enters a tailpipe 38 connecting the discharge outlet 36 to a waste line 39. One end of a tailpipe 38 attaches to the discharge outlet 36 using a coupling known in the art that has a rubberized discharge gasket 37*a* and a mounting flange 37*b*. Another end of the pipe 38 attaches to a waste line 39 of the household plumbing by techniques known in the art. Other discharge couplings can also be used, such as anti-vibration discharge coupling connecting the discharge 36 to the waste line 39. Vibration isolation discharge couplings having rubberized components are disclosed in U.S. patent application Ser. No. 10/300,219, filed Nov. 20, 2002, which is incorporated herein by reference in its entirety. For example, FIG. 3 shows a cross-section of an embodiment of a vibration isolation discharge coupling disclosed in the '219 application. The vibration isolation discharge coupling has a first tailpipe section 38*a*, an intermediate rubberized section 38*b*, and a second tailpipe section 39*c*. The first tailpipe section 38*a* connects to the discharge outlet (not shown) of the disposer, the second tailpipe section 38*c* connects to the waste line 39, and the intermediate rubberized section 38*b* interconnects the two tailpipe sections 38*a*, 38*c*. The rubberized section 38*b* can be made of nitrile (NBR) rubber, EPDM rubber, or chlorobutyl (CIIR) rubber. This and other discharge techniques and couplings can be used with the disposer 10 and can benefit from the disclosed antimicrobial techniques.

Returning again to FIG. 1, the inlet housing 20 is attached to the grinding housing 30 using a flange 26 and a plurality of bolts 28 (one shown). The inlet housing 20 has a cylindrical wall 22 and an inlet 24. In the present embodiment, the upper housing 20 is preferably composed of stainless steel but could be composed of an injection-molded plastic, as described below. The inlet housing 20 can also include a dishwasher inlet 23 that receives water and waste from a dishwasher (not shown). The dishwasher inlet 23 is preferably composed of an injection-molded plastic, such as acrylonitrile butadiene styrene (ABS), polyvinyl chloride (PVC), polyester, and polyphenylene sulfide, but could be composed of metal, such as stainless steel.

Figure 4:
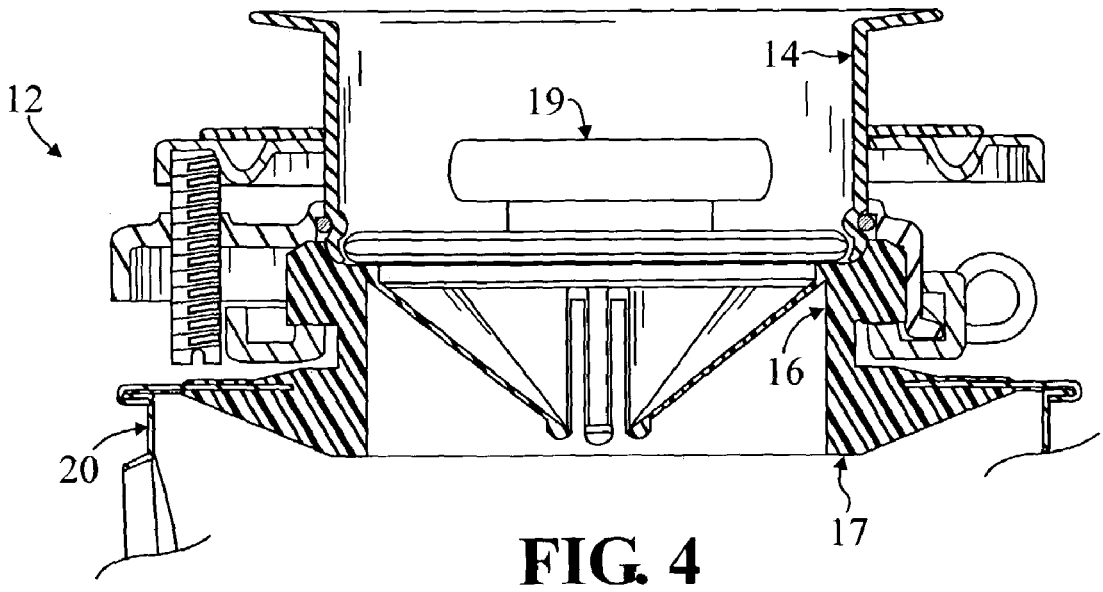
FIG. 4 illustrates a cross-section of a portion of a food waste disposer having a vibration isolation mounting device for attaching the disposer to a sink.

The inlet 24 of the housing 20 attaches to a sink (not shown) using a mounting mechanism 12. A number of mounting mechanisms known in the art can used to attach the disposer 10 to the sink. In the present embodiment, the mounting mechanism 12 used is similar to that disclosed in U.S. Pat. No. 3,025,007, which is incorporated herein by reference in its entirety. The mounting mechanism 12 includes a sink flange 14 and a mounting gasket 16. Other mounting techniques and devices can be used with the disposer 10. For example, vibration isolation mounting devices for use with the disposer 10 are disclosed in U.S. patent application Ser. No. 10/300,219, filed Nov. 20, 2002, which is incorporated herein by reference in its entirety. In another example, U.S. patent application Ser. No. 10/404,581, filed Apr. 1, 2003 and entitled "Over-Molded Vibration Isolation Gasket for Mounting Food Waste Disposer to Sink," which is incorporated herein by reference in its entirety, discloses vibration isolation mounting devices having a rubberized mounting gasket that can be used to isolate vibration at the attachment of the disposer 10 to the sink. In FIG. 4, one such mounting gasket 16 from that application is illustrated having a portion 17 over-molded onto atop of the housing 20 of the disposer 10. These and other mounting devices can be used with the disposer 10 and can benefit from the disclosed antimicrobial techniques. Such rubberized portions of the vibration isolation mount can be formed of nitrile (NBR) rubber, EPDM rubber, chlorobutyl (CIIR) rubber, or neoprene rubber.

In FIG. 4, a stopper 19 is shown in the opening of the sink flange 14. The stopper 19 removably fits within the sink flange 14 and can either entirely or partially close the inlet 24 (FIG. 1) of the disposer 10 from the sink. The stopper 19 can be composed of plastic, rubber, metal, or a combination of these materials. For example, the stopper 19 may be composed primarily of plastic or stainless steel and may have a rubber seal around it periphery. The stopper 19 can be used to hold water in the sink or can be used to operate the disposer 10 during a batch feed operation, such as is disclosed in U.S. patent application Ser. No. 10/389,160, filed Mar. 14, 2003 and entitled "Switching Mechanism for a Batch Feed Waste Disposer," which is incorporated herein by reference in its entirety. This and other such stopper designs can be used with the disposer 10 and can benefit from the disclosed antimicrobial techniques.

In FIG. 1, the inlet 24 of the disposer 10 is illustrated with a baffle 18 used in the opening of the sink flange 14. The baffle 18 removably fits within the sink flange 14, but other baffle designs can be used, such as those disclosed in U.S. patent application Ser. No. 09/997,678, filed Nov. 29, 2001 and entitled "Food Waste Disposer Having Mechanism and Method For Creating a Water Baffle to Reduce Noise," and Ser. No. 10/066,893, filed Feb. 4, 2002 and entitled "Baffle for a Food Waste Disposer to Reduce Noise and Associated Methods," which are both incorporated herein by reference in their entireties. These and other such baffle designs can be used with the disposer 10 and can benefit from the disclosed antimicrobial techniques.

Figure 2:
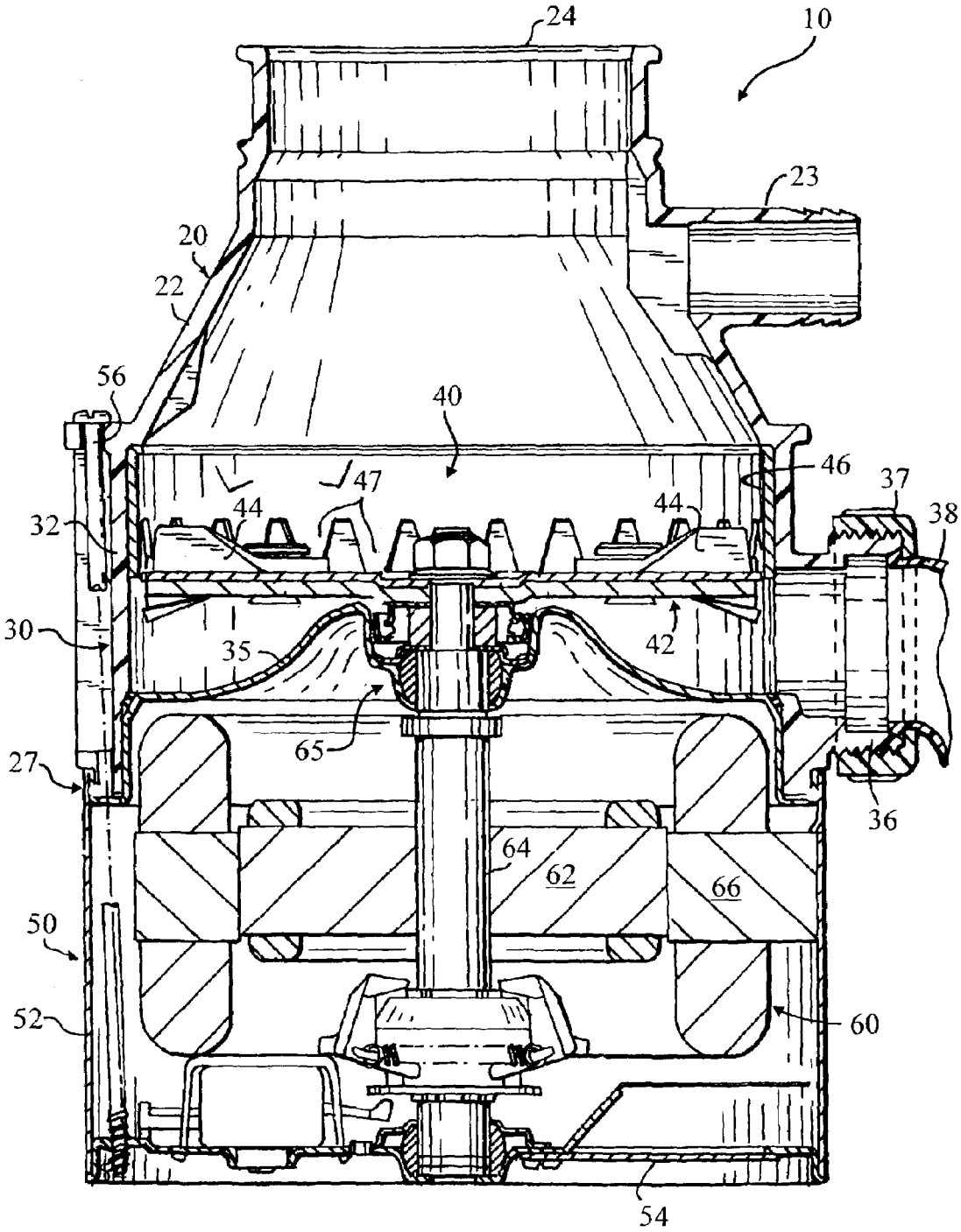
FIG. 2 illustrates a cross-section of another embodiment of a food waste disposer.

Referring now to FIG. 2, another embodiment of a food waste disposer 10 is illustrated in cross-section which differs in certain ways from the construction of the disposer of FIG. 1 as will be explained. In FIG. 2, like reference numerals indicate substantially similar components with the embodiment of FIG. 1 and thus their descriptions are not repeated here.

The inlet housing 20 of FIG. 2 is preferably composed of an injection-molded plastic that exhibits impact resistance, heat resistance, and corrosion resistance. Some suitable plastic materials for the housing 20 include acrylonitrile butadiene styrene (ABS), polyvinyl chloride (PVC), polyester, and polyphenylene sulfide.

The grinding housing 30 in FIG. 2 is formed from a plastic sidewall 32 integrally attached to the inlet housing 20. A metal upper end frame 35 is used to separate the integral housings 20, 30 from the motor housing 50. Further details concerning the grinding housing 30, plastic sidewall 32, and metal upper end frame 35 are disclosed in U.S. Pat. No. 6,007,006, which is incorporated herein by reference in its entirety. The plastic sidewall 32 is injection molded and integrally formed with the injection-molded inlet housing 20 to form a unitary enclosure of injection-molded plastic. The metal upper end frame 35 is preferably composed of stamped metal, such as double-sided galvanized cold-rolled steel, cold-rolled steel, stainless steel, or other types of steel and formed using conventional cold stamping techniques. Alternatively, the upper end frame 35 can be composed of a structurally rigid plastic material, such as ABS or PVC. The enclosure formed by the integral housings 20, 30 is fastened to the motor housing 50 by a plurality of bolts 56 having self-tapping threads that connect to the lower end frame 54.

Although the food waste disposer 10 in FIGS. 1 and 2 operates efficiently and effectively, they, like other food waste disposers, provide a wet and organic environment that is susceptible to microbial growth, such as bacteria, fungus, and mold. For example, the inlet housing 20 and the grinding housing 30, components of the attachment mechanism 12, such as the sink flange 14, mounting gasket 16, and baffle 18, components of the grinding mechanism 40, and the tailpipe 38 encounter food waste and water. Accordingly, these and other components of the disposer 10 can foster microbial growth. To prevent this, one or more of these (or other) components of the food waste disposer 10 preferably includes antimicrobial features as disclosed below.

B. Components of the Disposer Having Embedded Antimicrobial Agents

1. Plastic Components Having Embedded Antimicrobial Agents

In accordance with one aspect of this disclosure, one or more of the plastic components of the disposer 10 are preferably formed with an antimicrobial agent embedded in the material of the component. Suitable plastic components lending themselves to the disclosed antimicrobial treatment include the plastic inlet housing 20 (FIG. 1), the integral plastic housing sections 20 and 30 (FIG. 2), the plastic dishwasher inlet 23, the plastic grinding housings 30 (FIGS. 1 and 2), the plastic liner 33 (FIG. 1), the plastic upper end frame 35 (FIG. 2), and the plastic tailpipe 38, although other plastic components could be similarly treated.

There are several manufacturers of antimicrobial agents and several techniques for embedding the agent into the plastic material that can be used with the plastic components of the disposer 10. In one example, a surface of a disposer component composed of a polymeric material can be impregnated with a non-leaching antimicrobial metal, such as silver, using techniques disclosed in U.S. Pat. No. 5,520,664, which is incorporated herein by reference in its entirety.

In another example, MICROBAN™ additives, which can be obtained from MICROBAN International Ltd., are suitable antimicrobial agents for embedding in the plastic components of the disposer 10. Particular teachings relevant to the use of antimicrobial agents, such as MICROBAN additives, are disclosed in U.S. Pat. Nos. 4,533,435, 5,919,554, 6,108,847, 6,171,496, 6,238,575, 6,283,308, 6,448,305, 6,531,519, 6,540,915, and 6,540,916, which are incorporated herein by reference in their entireties.

In general, MICROBAN constitutes an additive that is incorporated into the resin used to make a plastic component. The MICROBAN additive and the resin for the plastic component are blended together, melted, and extruded into molds to form the plastic component of the disposer 10. Through this process, the active antimicrobial agent of the additive is built into the molecular structure of the plastic component of the disposer 10. Because the antimicrobial agent is thoroughly mixed with the plastic material for the disposer component, the antimicrobial agent will not wash or wear out for the useful lifetime of the disposer 10. Furthermore, various cuts, scratches, nooks, and hard to clean areas that may exist in the component of the disposer 10 can still have antimicrobial protection.

Consideration of a number of factors may be necessary when selecting an appropriate concentration and type of antimicrobial agent to add to the plastic components of the disposer 10. For example, the type of plastic may dictate the concentration and type of antimicrobial agent to be used. Moreover, higher concentrations of antimicrobial additives may be need for plastic components frequently exposed to food waste. For example, the plastic dishwasher inlet 23 of the disposer 10 may require a smaller concentration of an antimicrobial agent than would the plastic housing 20, 30. For a plastic housings 20, 30 composed of ABS, a MICROBAN additive package of SAN/B #2100-100 at a concentration of approximately 2000 p.p.m. has been shown to produce acceptable bacterial and fungal protection at a substantially low loading level. This additive comprises chlorinated phenoxy, although other agents such as diiodomethyl-p-tolylsulfone (in MICROBAN™ AF), or both together, could also be used. Of course, this additive and its concentration are merely illustrative, and one skilled in the art will understand that modifications are possible.

2. Rubber Components Having Embedded Antimicrobial Agents

One or more of the rubber components of the disposer 10 can also be formed with an antimicrobial agent embedded in the rubber material. Rubber components of the disposer 10 benefiting from such treatment include, for example, the mounting gasket 16, the baffle 18, and the discharge gasket 37*b*. In addition, rubberized components of a vibration isolation discharge coupling, such as shown in FIG. 3, and rubber components of a vibration isolation mounting device, such as shown in FIG. 4, can also benefit from having an antimicrobial agent embedded in the material. Preferably, the antimicrobial agent is added to the rubber material for the rubber component before the injection molding process, which prevents the antimicrobial agent from washing away or wearing off the during the operational lifetime of the component.

In one example, the mounting gasket 16 (FIG. 1) of the attachment mechanism 12, which is preferably formed of nitrile (NBR) rubber, EPDM rubber, or chlorobutyl (CIIR) rubber, can include an embedded antimicrobial agent such as MICROBAN additive package B/AF #10100-909 having a concentration of approximately 1000 p.p.m. A mounting gasket so fabricated has been shown to produce acceptable bacterial and fungal protection at a substantially low loading level in the material of the mounting gasket. A similar concentration and additive can also be used for various other components of the disposer 10 composed of rubber, such as the rubberized baffle 18 of FIG. 1 and the vibration isolation components described above.

C. Other Modifications

Other embeddable antimicrobial agents and plastics containing such agents can be used with the disposer 10. For example, Wells Plastics offers antimicrobial additives for polymers, including the T-Series, which is based on Tricolsan, and IONPURE, an inorganic silver-based compound. Wells Plastics also offers other antimicrobial additives for use with plastics and/or rubbers, including Dupont's MICROFREE and Akzo Nobel's INTERCIDE. Akcros Chemicals of Eccles, Manchester, UK offers INTERCIDE products that can be used in flexible PVC and offers biocides for other plastics as well. In particular, INTERCIDE DP8438F can be used with polyolefins and can confer antimicrobial properties to the surface of a product composed of a polyolefin and INTERCIDE. PBM Plastics of Newport News, Va. offers antimicrobial materials that include a zirconium phosphate-based ceramic, ion-exchange resin containing silver. As is known, silver, like other antimicrobial metals, is effective against a broad spectrum of microorganisms that cause odor, discoloration, biofouling, and other aesthetic problems. R.T. Vanderbilt Company, Inc. of Norwalk, Conn. offers a bioside/fungicide called VANCIDE 89, which acts as a preservative for susceptible plasticizers in rubber and plastics compounds. Thus, VANCIDE 89 can reduce the breakdown and deterioration of rubber components caused by fungi, as well as odors emitted by fungi. Ensinger Gmbh offers antimicrobial plastics containing the antimicrobial agent AGION, which prevents growth and migration of bacteria, yeasts, molds, and fungi. The antimicrobial agent AGION is based on a dosage system, in which silver ions are emitted in a controlled fashion for long-term effectiveness, and which is proven to inhibit the growth of microbes such as coli bacteria, salmonella, and staphylococci.

C. Components of Disposer Having Antimicrobial Coatings

Coatings may also be used to provide antimicrobial resistance to various components in the food waste disposer 10. Such components are preferably composed of metal, but may also be formed of plastic or rubber.

1. Metal Components Having Antimicrobial Coatings

One or more of the metal components of the disposer 10 are preferably coated with an antimicrobial coating. Suitable metal components of the disposer 10 which lend themselves to such treatment include, but are not limited to the metal sink flange 12, the metal inlet housing 20 (FIG. 1), the metal grinding housing 30 (FIG. 1), the shredder plate 42, the lugs 44, the shredder ring 46, and the metal upper end frame 35 (FIG. 2), although other metal components could be similarly treated. In addition, the metal motor housing 50 and the lower end frame 54 can also have an antimicrobial coating that may preferably be applied at least on its outer surface, although it is specially preferred to provide a coating to those metal components that come into frequent contact with food waste or that users might contact.

There are several antimicrobial coatings that can be used to coat the metal components of the disposer 10. A preferred antimicrobial coating for use with metal components of the disposer 10 includes AGION™ antimicrobial compounds, which can be obtained from AGION Technologies. Particular teachings of antimicrobial agents, such as AGION, are disclosed in U.S. Pat. Nos. 6,248,342, 6,267,590, 6,296,863, 6,365,130, and 6,436,422, which are incorporated herein by reference in their entireties. In general, AGION is an antimicrobial compound having an active ingredient of silver ions bonded to a naturally occurring ceramic material, such as zeolite. The silver zeolite combination is formed into a powder and is blended into an epoxy resin that can be applied to the metal component (e.g., inlet housing 20 of FIG. 1) by one of two methods, including roll coating the component with the AGION epoxy, and powder coating, in which the AGION epoxy is formed into a fine powder and is electrostatically attracted to the disposer component by techniques known in the art and as further described below.

As is known, the growth of microbes can occur on metal components, such as the metal housing, when exposed to moisture, including ambient moisture in the air. When coated with antimicrobial agent, the moisture causes release of silver ions from the coating, which can kill microbes by interacting with multiple binding sites on the surface of the microbes. Preferably, the antimicrobial coating has a maximum release rate of silver so that the silver releases very slowly even with increased moisture, insuring long-term protection for the coated metal housing 20. Other antimicrobial metals can be used as well.

For coating metal components of the disposer 10, such as the stainless steel inlet housing 20 described in FIG. 1, it is preferred that the component be powder coated with the antimicrobial agent. When powder coating, fine particles of the coating are electrostatically charged and sprayed onto a surface of the component to be coated. These charged powder particles adhere to the surface until they are heated and fused into a uniform and durable coating. DuPont powder coating technology is one example of a coating technology that uses the antimicrobial agent AGION to produce a relatively scratch and abrasion resistant coating for metal. The AGION antimicrobial agent can be incorporated directly into a variety of hydrocarbon binders, such as epoxy, polyester, epoxy/polyester hybrids, and acrylics. The powder coatings with the AGION can then be applied and cured like conventional powder coatings using DuPont RAY-TEC Ultraviolet (UV) and Near Infrared (NIR) Powder Coating Technologies.

Antimicrobial coatings can also applied to metal components of the grinding mechanism 40 of the disposer 10, such as the shredder plate 42, lugs 44, and the shredder ring 46. As noted above, the shredder plate 42 and lugs 44 are preferably composed of stainless steel, and the shredder ring 46 is preferably composed of stainless steel or NiHard. These components of the grinding mechanism 40 are subject to impact forces, which can potentially scratch or wear the antimicrobial coating applied to the components. Therefore, a substantially scratch and abrasion resistant coating for metal, such as those offered by DuPont and discussed above, are preferably used for these components.

2. Plastic and/or Rubber Components Having Antimicrobial Coatings

Plastic and/or rubber components of the disposer 10 can also be coated with an antimicrobial coating. Suitable plastic and rubber components of the disposer 10 benefiting from such coatings include the plastic inlet housing 20 (FIG. 1), the integral housings 20 and 30 (FIG. 2), the dishwasher inlet 23, the plastic grinding housing 30, the liner 33 (FIG. 1), the plastic upper end frame 35 (FIG. 2), the tailpipe 38, the mounting gasket 16, the baffle 18, and the discharge gasket 37*b*. In addition, rubberized components of a vibration isolation discharge coupling, such as shown in FIG. 3, and rubberized components of a vibration isolation mounting device, such as shown in FIG. 4 and incorporated herein, can also benefit from having an antimicrobial coating.

The antimicrobial coatings that can be used with metal components, discussed above, may also be used to coat the rubber and plastic components of the disposer 10. For example, the plastic and rubber components of the disposer 10, such as the plastic housings 20, 30 of FIGS. 1 and 2, the mounting gasket 16 of FIG. 1, and others, can be surface coated with an antimicrobial coating having an antimicrobial agent, such as AGION or compounds contain other antimicrobial metals.

Consideration of a number of factors may be necessary when selecting an appropriate antimicrobial coating for the components of the disposer 10. For example, the effects of temperature on the coating, the expected lifetime of the coating, the scratch and abrasion resistance of the coating, the flexibility of the coating (should it be applied to a flexible component), and the effectiveness against various microorganisms should be considered.

D. Summary

In short, the foregoing disclosure makes clear that many, or all, of the components which make up a food waste disposer can be made to be antimicrobial resistant, without significant limitation and using well known techniques. While the various method for rendering the components antimicrobial, as well as the various materials for these components, are discussed separately above, one skilled in the art will appreciate that any combination of the disclosed components, and their methods of treatment, can be used in fabricating a food waste disposer.

As used in this disclosure, plastics and rubbers are distinct from one another. "Antimicrobial metals," consistent with the definition provided in U.S. Pat. No. 5,520,664, col. 5, 11. 3-8, refer to elements which exhibit antimicrobial properties, including chromium, zirconium, aluminum, nickel, tungsten, molybdenum, tantalum, platinum, palladium, iridium, gold, silver, mercury, copper, zinc, cadmium, and alloy or compounds thereof. Antimicrobial metals do not include halide elements, such as chlorine, bromine, or iodine.

The foregoing description of preferred and other embodiments is not intended to limit or restrict the scope or applicability of the inventive concepts conceived of by the Applicant. It is intended that the invention include all modifications and alterations to the full extent that they come within the scope of the following claims or the equivalents thereof.

What is claimed is:

1. A food waste disposer, comprising:

a grinding chamber for reducing food waste;

a stationary shredder ring attached to an inner wall of the grinding chamber, the stationary shredder ring having a plurality of teeth;

a rotating shredder plate assembly having an upper rotating plate and a lower support plate adjacent the rotating shredder plate;

a plurality of lugs attached to the upper rotating plate by a stationary member extending through the upper rotating plate and the lower support plate such that the lugs are rotatable relative to the upper rotating plate to force the food waste against the teeth of the stationary shredder ring to grind the food waste into particulate matter; and a rubber or plastic component that contacts the food waste, the rubber or plastic component having an embedded antimicrobial agent and being at least one of a load bearing component and a vibration isolating component.

2. The food waste disposer of claim 1, wherein the rubber or plastic component includes an inlet housing which communicates food waste to the grinding chamber.

3. The food waste disposer of claim 2, wherein the inlet housing is a load bearing component.

4. The food waste disposer of claim 1, further comprising a dishwasher inlet having an embedded antimicrobial agent.

5. The food waste disposer of claim 1, further comprising:

a removable rubber component which contacts the food waste having an embedded antimicrobial agent.

6. The food waste disposer of claim 5, wherein the removable rubber component comprises a baffle positionable in an inlet to the food waste disposer.

7. The food waste disposer of claim 5, wherein the removable rubber component is positionable within a drain opening in a sink to which the disposer is attached.

8. The food waste disposer of claim 1, wherein the rubber or plastic component includes a rubber component which isolates vibration.

9. The food waste disposer of claim 8, wherein the rubber vibration isolation component includes an anti-vibrational mount for affixing the food waste disposer to a sink.

10. The food waste disposer of claim 8, wherein the rubber vibration isolation component comprises a vibration isolation discharge coupling for connecting a tailpipe to the disposer.

11. The food waste disposer of claim 8, wherein the rubber vibration isolation component bears a weight of the disposer.

12. The food waste disposer of claim 1, wherein the rubber or plastic component is a load bearing component.

13. The food waste disposer of claim 12, wherein the load bearing component is a plastic load bearing component.

14. The food waste disposer of claim 1, wherein the rubber or plastic component is a vibration isolating component.

15. The food waste disposer of claim 14, wherein the vibration isolating component is a rubber vibration isolating component.

16. A food waste disposer, comprising:

an inlet housing including a first molded plastic housing for receiving food waste;

a motor housing including a motor for imparting rotational movement to a motor shaft;

a grinding chamber for reducing food waste, the grinding chamber being disposed between the inlet housing and the motor housing, the inlet housing conveying the food waste to the grinding chamber, the grinding chamber including a grinding mechanism having a portion mounted to the motor shaft, the grinding mechanism grinding the food waste into particulate matter, the grinding chamber including a second molded plastic housing encompassing the grinding mechanism and integrally formed with the first plastic housing, the second molded plastic housing having a discharge outlet; and wherein the first molded plastic housing and the second plastic molded housing have an embedded antimicrobial agent and are least one of a load bearing component and a vibration isolating component.

17. The food waste disposer of claim 16, further comprising a liner for receiving reduced food waste below a grinding plate positioned within the grinding chamber, the liner being made of plastic and having an embedded antimicrobial agent.

18. The food waste disposer of claim 16, further comprising a dishwasher inlet made of plastic and having an embedded antimicrobial agent.

19. The food waste disposer of claim 18, wherein the first and second plastic housings and the dishwasher inlet are comprised of ABS, the first and second plastic housings having a concentration of approximately 2,000 ppm of the embedded antimicrobial agent, and the dishwasher inlet having a concentration of less than 2,000 ppm of the embedded antimicrobial agent.

20. The food waste disposer of claim 19, further comprising a removable rubber component which contacts the food waste, wherein the removable rubber component includes an embedded antimicrobial agent having a concentration of approximately 1,000 ppm.

21. The food waste disposer of claim 16, wherein at least one of the first and second housings is load bearing.

22. The food waste disposer of claim 21, wherein both of the first and second housings are load bearing.

23. The food waste disposer of claim 16, further comprising a rubber component which isolates vibration and has an embedded antimicrobial agent.

24. The food waste disposer of claim 23, wherein the rubber vibration isolation component includes an anti-vibrational mount for affixing the food waste disposer to a sink.

25. The food waste disposer of claim 23, wherein the rubber vibration isolation component comprises a vibration isolation discharge coupling for connecting a tailpipe to the disposer.

26. The food waste disposer of claim 23, wherein the rubber vibration isolation component bears a weight of the disposer.

27. A food waste disposer, comprising:

a grinding chamber for reducing food waste;

a stationary shredder ring attached to an inner wall of the grinding chamber, the stationary shredder ring having a plurality of teeth;

a rotating shredder plate assembly having an upper rotating plate and a lower support plate adjacent the rotating shredder plate;

a plurality of lugs attached to the upper rotating plate by a stationary member extending through the upper rotating plate and the lower support plate such that the lugs are rotatable relative to the upper rotating plate to force the food waste against the teeth of the stationary shredder ring to grind the food waste into particulate matter;

a rubber vibration isolating component that contacts the food waste and has an embedded antimicrobial agent; and a plastic load bearing component that contacts the food waste and has an embedded antimicrobial agent.

28. The food waste disposer of claim 27, wherein the plastic load bearing component is an inlet housing which communicates food waster to the grinding chamber.

29. The food waste disposer of claim 27, further comprising a dishwasher inlet made of plastic and having an embedded antimicrobial agent.

30. The food waste disposer of claim 27, further comprising a liner for receiving reduced food waste below a grinding plate positioned within the grinding chamber, the liner being made of plastic and having an embedded antimicrobial agent.

31. The food waste disposer of claim 27, wherein the rubber vibration isolating component includes an anti-vibrational mount for affixing the food waste disposer to a sink.

32. The food waste disposer of claim 27, wherein the rubber vibration isolating component comprises a vibration isolation discharge coupling for connecting a tailpipe to the disposer.

33. The food waste disposer of claim 27, wherein the rubber vibration isolating component bears a weight of the disposer.

* * * * *

UNITED STATES PATENT AND TRADEMARK OFFICE

CERTIFICATE OF CORRECTION

PATENT NO. : 7,578,460 B2
APPLICATION NO. : 10/463293
DATED : August 25, 2009
INVENTOR(S) : Thomas R Berger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1087 days.

Signed and Sealed this

Seventh Day of September, 2010

David J. Kappos

David J. Kappos
*Director of the United States Patent and Trademark Office*